US007730556B2

(12) United States Patent
Chou

(10) Patent No.: US 7,730,556 B2
(45) Date of Patent: Jun. 8, 2010

(54) NOSE STRAP JOINTING STRUCTURE FOR SWIMMING GOGGLES/MASK

(75) Inventor: Shu-Fang Chou, Yunghe (TW)

(73) Assignee: First Rank Co., Ltd., Taipei Hsien (TW)

( * ) Notice: Subject to any disclaimer, the term of this patent is extended or adjusted under 35 U.S.C. 154(b) by 344 days.

(21) Appl. No.: 11/834,017

(22) Filed: Aug. 6, 2007

(65) Prior Publication Data

US 2009/0038063 A1 Feb. 12, 2009

(51) Int. Cl.
*A61F 9/02* (2006.01)

(52) U.S. Cl. ..... 2/445

(58) Field of Classification Search ..... 2/445, 2/446

See application file for complete search history.

(56) References Cited

U.S. PATENT DOCUMENTS

| | | | | | |
|---|---|---|---|---|---|
| 4,468,819 | A | * | 9/1984 | Ohno | 2/430 |
| 5,706,527 | A | * | 1/1998 | Kita et al. | 2/452 |
| 5,884,339 | A | * | 3/1999 | Fukasawa | 2/446 |
| 6,145,133 | A | * | 11/2000 | Sato et al. | 2/428 |

* cited by examiner

*Primary Examiner*—Katherine Moran
(74) *Attorney, Agent, or Firm*—Leong C. Lei

(57) ABSTRACT

A swimming goggle structure includes two eye masks and a centrally located nose strap. Each eye mask has an outer edge forming a head strap buckle to which a head strap is connected and an inner edge forming a projecting joint section. The joint section forms a recessed slot and is jointed to an end of the nose strap by insert molding so that the end of the nose strap wraps and engages the joint section of each eye mask to form a tightly connected structure.

2 Claims, 4 Drawing Sheets

NOSE STRAP JOINTING STRUCTURE FOR SWIMMING GOGGLES/MASK

BACKGROUND OF THE INVENTION (a) Technical Field of the Invention

The present invention relates to a structure that joints a centrally located nose strap and two eye masks of swimming goggles.

(b) Description of the Prior Art

Swimming goggles or masks are commonly used in doing water activities, such as swimming in the sea or in a swimming pool. Besides the full face mask that is used in diving, most of the swimming goggles for water activities are made in the form of a pair of "eyeglass", having two eye masks jointed by a centrally located nose strap.

FIG. 4 of the attached drawings illustrates a portion of a pair of conventional swimming goggles, which comprise two eye masks 50 of which only one is illustrated. The eye mask 50 is a transparent or light-transmitting cover or shield having a rim that has an outer edge and an opposite inner edge. The outer edge forms a head strap buckle to which a head strap (not shown) is attached. The inner edge forms a bent section 51 that is of fixed thickness. Through holes 52 are defined through the bent section 51. A nose strap 60 has opposite end jointed to the eye masks 50 by over molding so that the material that forms the nose strap 60 and that is soft fills into the through holes 52 of the bent section 51 to form material pillars 61. In this way, the eye masks 50 on the opposite sides of the nose strap 60 are connected together. Practical use of the swimming goggles of this type reveals the following disadvantages:

(1) The soft material of the end of the nose strap is filled into the through holes defined in the bent section of the eye mask in the over molding process to form pillars and during such a process, air entrains the soft material into the through hole, making the pillar insufficient in structural strength and easy to break.

(2) Further, the mold for carrying out the above mentioned process is very complicated, and this makes the manufacturing cost of the swimming goggle mold very high.

SUMMARY OF THE INVENTION

The primary purpose of the present invention is to provide a jointing structure that joints a nose strap to eye masks on opposite sides, wherein an inner edge of each eye mask forms a projecting joint section in which a recessed slot is defined and the joint section and an end of the nose strap are jointed together by insert molding so that the end of the nose strap is allowed to fill into and wrap the joint section of the eye mask to form a tight connection therebetween for improved tightness and waterproof capability.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
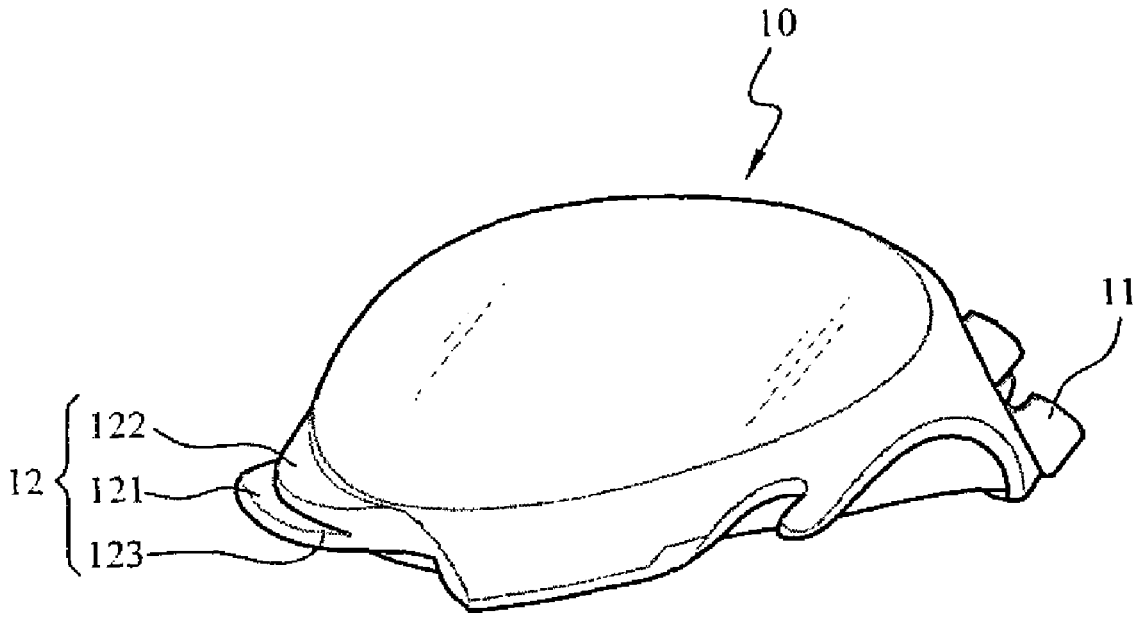
FIG. 1 is a perspective view showing an eye mask of swimming goggles that is jointed to a nose strap with a jointing structure in accordance with the present invention.
Figure 2:
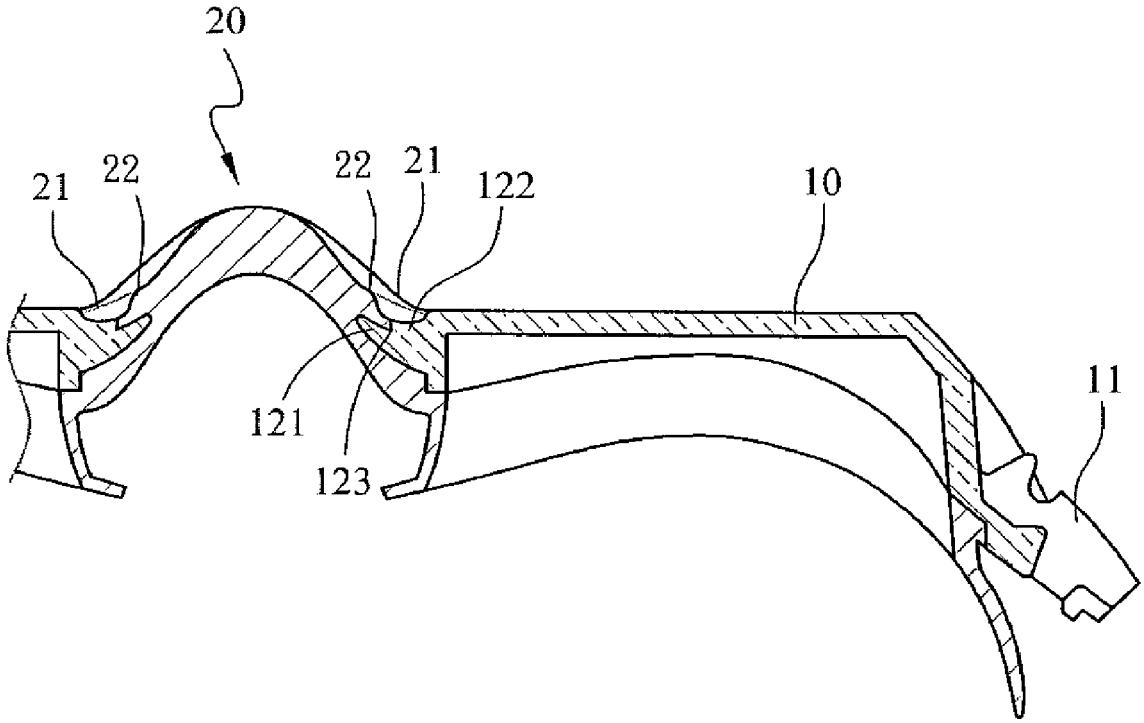
FIG. 2 is a cross-sectional view of the swimming goggles in accordance with the present invention.
Figure 3:
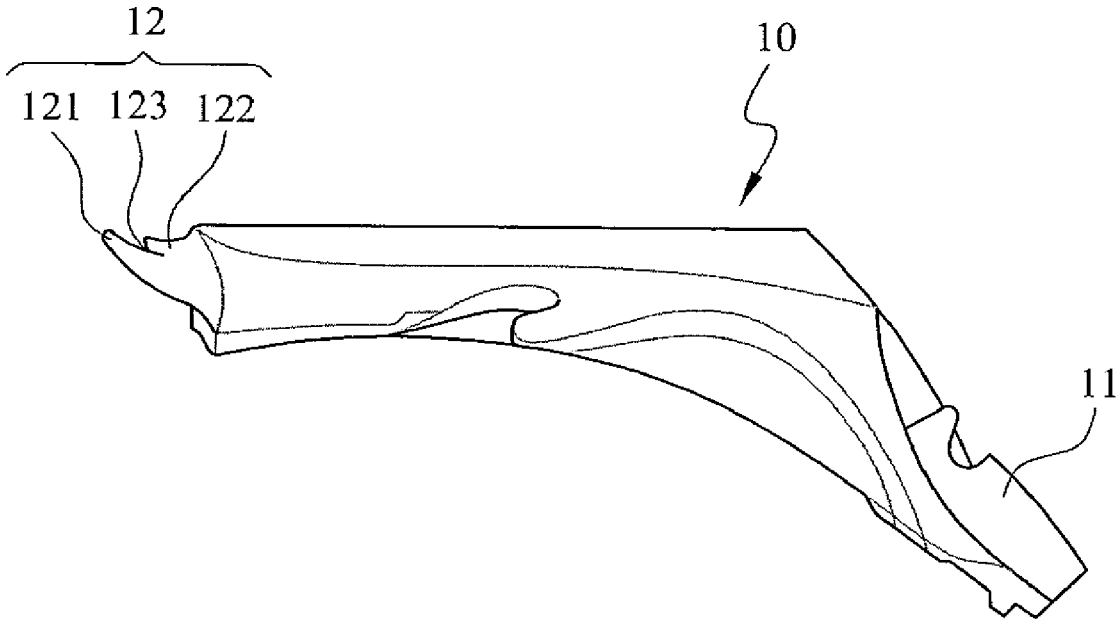
FIG. 3 is a top view of the eye mask of the swimming goggles of the present invention.
Figure 4:
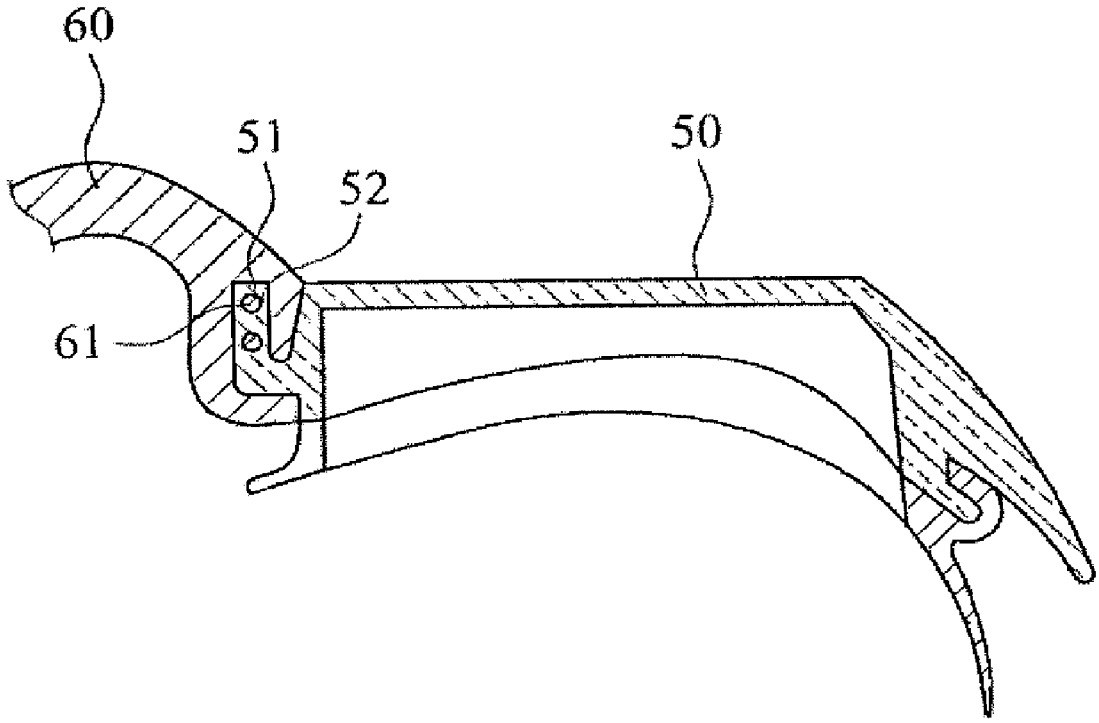
PRIOR ART FIG . 4
FIG. 4 is a cross-sectional view showing a portion of conventional swimming goggles.

With reference to the drawings and in particular to FIGS. 1-3, swimming goggles in which a nose strap jointing structure in accordance with the present invention can be embodied are shown. The swimming goggles comprise two eye masks 10, each having a rim having an outer edge and an opposite inner edge. The outer edge of the rim forms a head strap buckle 11 to which a head strap (not shown) is connected. The inner edge of the rim forms a projecting joint section 12, which is composed of a front projection wing 121 and a rear projection wing 122 that are stacked each other in a staggered manner to thereby form a step-like configuration. Further, a recessed slot 123 is formed in an outside face of the step-like joint section 12, at a central portion thereof. The front projection wing 121 that is located outermost with respect to the rim is made slightly convex curved.

A nose strap 20 is an elongate member having two ends respectively jointed to the eye masks 10 by insert molding. In other words, the joint section 12 of the eye mask 10 is inserted into and fixed to a corresponding end 21 of the nose strap 20. In this way, the recessed slot 123 of the joint section 12 can be filled up with and covered by plastics that make the nose strap 20. Further, the nose strap 20 forms a protrusion 22 that has an increased thickness at a location corresponding to the front projection wing 121. The protrusion 22 enhances the mechanical/structural strength of the end 21 of the nose strip 20 and is effective in preventing the nose strap 20 from detachment or breaking.

Further, it is noted that the front projection wing 121 and the rear projection wing 122 do not need to be arranged in a stacked manner to form the step-like configuration, and can be replaced by an elongate body in which the slot 123 is defined. Such a modification is considered within the scope of the present invention.

The present invention has at least the following advantages:

(1) The joint section of the eye mask is inserted into an end of the nose strap that is made of plastics and they are fixed together by insert molding, which ensures improved structural strength and provides a seamless connection without water leaking. This is the major advantage of the present invention.

(2) The joint section is comprised of a front projection wing and a rear projection wing that are stacked in a staggered manner to from a step-like configuration and also, a recessed slot is defined in a central portion of the outside surface of the joint section to receive and fix a portion of the material of the nose strap so that the nose strap cannot be easily separated from the eye mask; and in addition, the outermost front projection wing has a slightly convex curved outside contour, whereby the eye mask is provided with sufficient thickness of material that is effective in fixing the nose strap and also enhances structural strength. This is another advantage of the present invention.

(3) The nose strap forms a protrusion having an increased thickness at a location corresponding to the front projection wing of the eye mask to provide improved structural strength at opposite ends of the nose strap, which effectively prevents the nose strap from undesired separation from the eye mask and protects the nose strap from breaking.

Although the present invention has been described with reference to the preferred embodiment thereof, it is apparent to those skilled in the art that a variety of modifications and changes may be made without departing from the scope of the present invention which is intended to be defined by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A swimming goggle comprising:

two eye masks each having a rim having an outer edge and an opposite inner edge, said inner edge of said rim being formed with a head strap buckle, said outer edge of said rim being formed with a projection joint section which is composed of a front projection wing, a rear projection wing that are stacked each other to form a step-like configuration, a recessed slot formed in an outside face of said step-like configuration, said front projection wing being made convex curved; and a nose strap having two ends respectively jointed to said eye masks by inserting said joint section into and fixed to a corresponding end of said nose strap and then filling said recessed slot with plastic by insert molding thereby engaging said nose strap with said eye masks, said nose strap being provided with a protrusion having an increased thickness at a location corresponding to said front projection wing of said eye masks.

2. The swimming goggle as claimed in claim 1, wherein said front projection wing and said rear projection wing are combined together as an elongate body.

* * * * *